US005680897A

United States Patent [19]

Kilmer

[11] Patent Number: 5,680,897

[45] Date of Patent: Oct. 28, 1997

[54] PLATE TYPE HEAT EXCHANGER WITH INTEGRAL FEED PIPE FIXTURING

[75] Inventor: Raymond Joseph Kilmer, Burt, N.Y.

[73] Assignee: General Motors Corporation, Detroit, Mich.

[21] Appl. No.: 716,670

[22] Filed: Sep. 12, 1996

[51] Int. Cl.[6] ..... F28D 1/03

[52] U.S. Cl. ..... 165/178; 165/153; 165/176

[58] Field of Search ..... 165/67, 153, 176, 165/178; 62/515

[56] References Cited

U.S. PATENT DOCUMENTS

| | | | |
|---|---|---|---|
| 3,310,869 | 3/1967 | La Porte et al. . | |
| 4,821,531 | 4/1989 | Yamauchi et al. . | |
| 4,867,486 | 9/1989 | Fukata et al. . | |
| 5,205,349 | 4/1993 | Nagao et al. . | |
| 5,240,068 | 8/1993 | Tokutake . | |
| 5,409,056 | 4/1995 | Farry, Jr. et al. . | |
| 5,429,182 | 7/1995 | Hanafusa | 165/178 X |
| 5,509,473 | 4/1996 | Tokutake . | |

*Primary Examiner*—Leonard R. Leo
*Attorney, Agent, or Firm*—Patrick M. Griffin

[57] ABSTRACT

A plate type evaporator core can be brazed in one step, even with long refrigerant feed pipes in place, and without the need for separate support fixtures or clips. This is done by stamping selected ones of the stamped plates that make up the core with integral feed pipe support flanges, located so as to coincide spatially with the desired final locations of the attachment end point of the feed pipes. The end points are supported on the flanges in the braze oven, and maintained in their proper locations regardless of any heat sagging of the rest of the feed pipe along its length.

3 Claims, 4 Drawing Sheets

PLATE TYPE HEAT EXCHANGER WITH INTEGRAL FEED PIPE FIXTURING

TECHNICAL FIELD

This invention relates to plate type heat exchangers in general, and specifically to a method for producing a plate type automotive air conditioning evaporator and core in which the refrigerant feed pipe end points are sufficiently supported on the core to allow the evaporator and core to be brazed together in one step, with the feed pipes in place.

BACKGROUND OF THE INVENTION

Evaporator cores used in automotive air conditioning systems are typically of a plate type, parallel flow construction, a typical example of which is illustrated in FIG. 1 at 10. A stacked series of shallow, wide, stamped aluminum alloy plates 12 are stacked together in face to face abutment and brazed together in a heated braze oven. When the edges of each abutted pair of plates 12 fuse together they form a series of wide, thin flow passages. An integral stamped cup 14 (or pair of cups) at the end of each plate 12 align end to end to form a pair of manifold tanks that distribute refrigerant to the flow passages. Corrugated cooling fins 16 are brazed between the fused pairs of plates 12. The cups 14 and the tanks they form may be at opposite sides of the core or side by side in the so called U flow type of evaporator core, which is increasingly common, and which is the type shown in FIG. 1. Typically, the plates 12 are identical, except the two endmost plates, which can be simple flat plates without the other stamped in features, such as bump patterns and divider ribs, that the main plates have.

Plate type evaporator cores of either type must have refrigerant fed at discrete points into and out of their manifold tanks by feed pipes, often called inlet and outlet pipes. These feed pipes may enter the manifold tanks at the ends, passing through the endmost plates. More and more designs are being proposed for so called "face plumbing", in which the feed pipes enter the manifold tanks at any desired point along the length of the tanks, generally by "plugging into" and replacing the dram cups 14 at selected points. An example may be seen in U.S. Pat. No. 4,821,531 issued Apr. 18, 1989 to Yamauchi et al. Or, a face plumbed type feed pipe may "plug in" only just inside the end plates, as in U.S. Pat. No. 4,487,038 issued Dec. 11, 1984 to Iijima. However, the term "pipe" is used rather loosely throughout various existing patents, sometimes to refer to a very short stub pipe, as in the Iijima reference. As a practical matter, such a short "pipe" is really no more than a stub fitting to which the inner end of a longer feed pipe is fixed later, generally by separate welding, after the main core brazing process is completed. Such long feed pipes are shown in FIG. 1, including an inlet pipe I and outlet pipe 0. Each feed pipe has a remote, threaded attachment end point 18, 20, to which refrigerant lines would be attached when the air conditioning system was installed. Proper location in space of the end points 18 and 20, relative to the core 10, is critical to final installation success.

In cases where the feed pipes are very short and located close together, as in U.S. Pat. No. 4,867,486 issued Sep. 19, 1989 to Fukata et al, it is possible to braze the feed pipes into the core directly. However, the process proposed still requires the use on separate support clips in the braze oven, which are later removed, in order to hold the pipes in place. Even then, the feed pipes must be short and located side by side, with adjacent attachment end points that are still subject to tilting off axis during the brazing process. There is no known, practical process for brazing long, meandering feed pipes with remote end points integrally to the core. This is because the brazing process would cause the feed pipes to sag and lose their original shape, moving the end points out of their proper, final build position.

SUMMARY OF THE INVENTION

The invention provides a practical process for brazing long feed pipes with remote attachment end points integrally to a stacked, plate type evaporator core. The end points are integrally fixtured and supported on the core without the need for additional basic components.

In the embodiment disclosed, the core designer determines the desired final locations for the attachment end points of the feed pipes. Then, those core plates (or plate) closest to the final end point locations are determined. Then, the selected plate or plates are replaced with support plates that are stamped with an integral, upstanding support flange. The flange corresponds as closely as possible to the desired final end point location of the feed pipe or pipes. In the embodiment disclosed, a slot (with an adjacent supporting shelf) is formed in the flange to support the feed pipe at a point near the threaded end point. The supporting shelf is also clad with a layer of braze material, since the base plate itself is clad. When the feed pipes are assembled to the core, the feed pipe end points rest on the flanges, held in their proper location. During the brazing process, although the unsupported length of the feed pipe may sag or wander, the attachment end points are solidly held in their proper position. When the core cools, the feed pipe end points are also fused to the flanges, protected against damage during shipping and handling, prior to final installation of the evaporator core.

BRIEF DESCRIPTION OF THE DRAWINGS

These and other features of the invention will appear from the following written description, and from the drawings, in which.

DESCRIPTION OF THE PREFERRED EMBODIMENT

Figure 2:
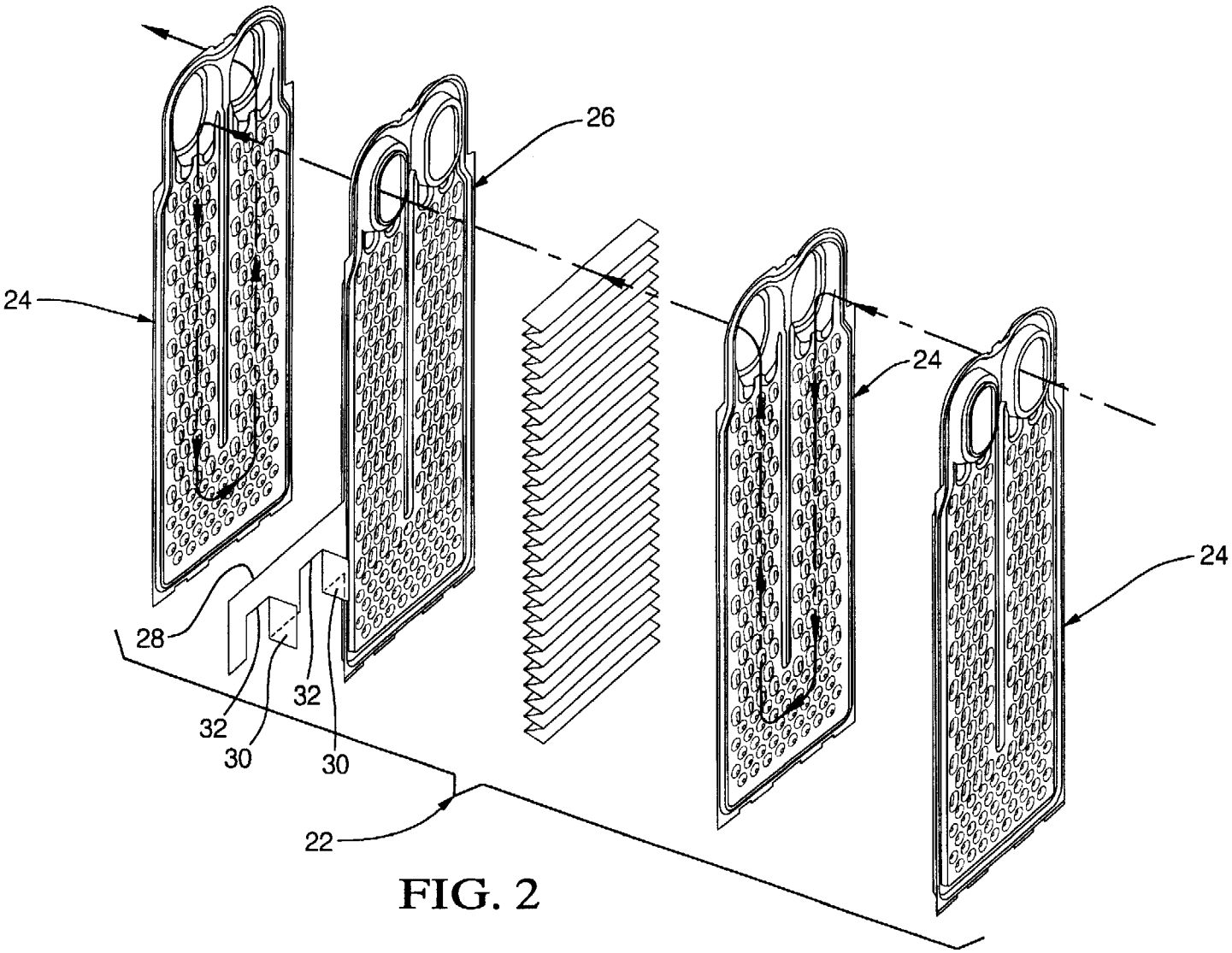
FIG. 2 is a perspective view of two pairs of stamped plates and one corrugated fin that make up the core of the invention.
Figure 6:
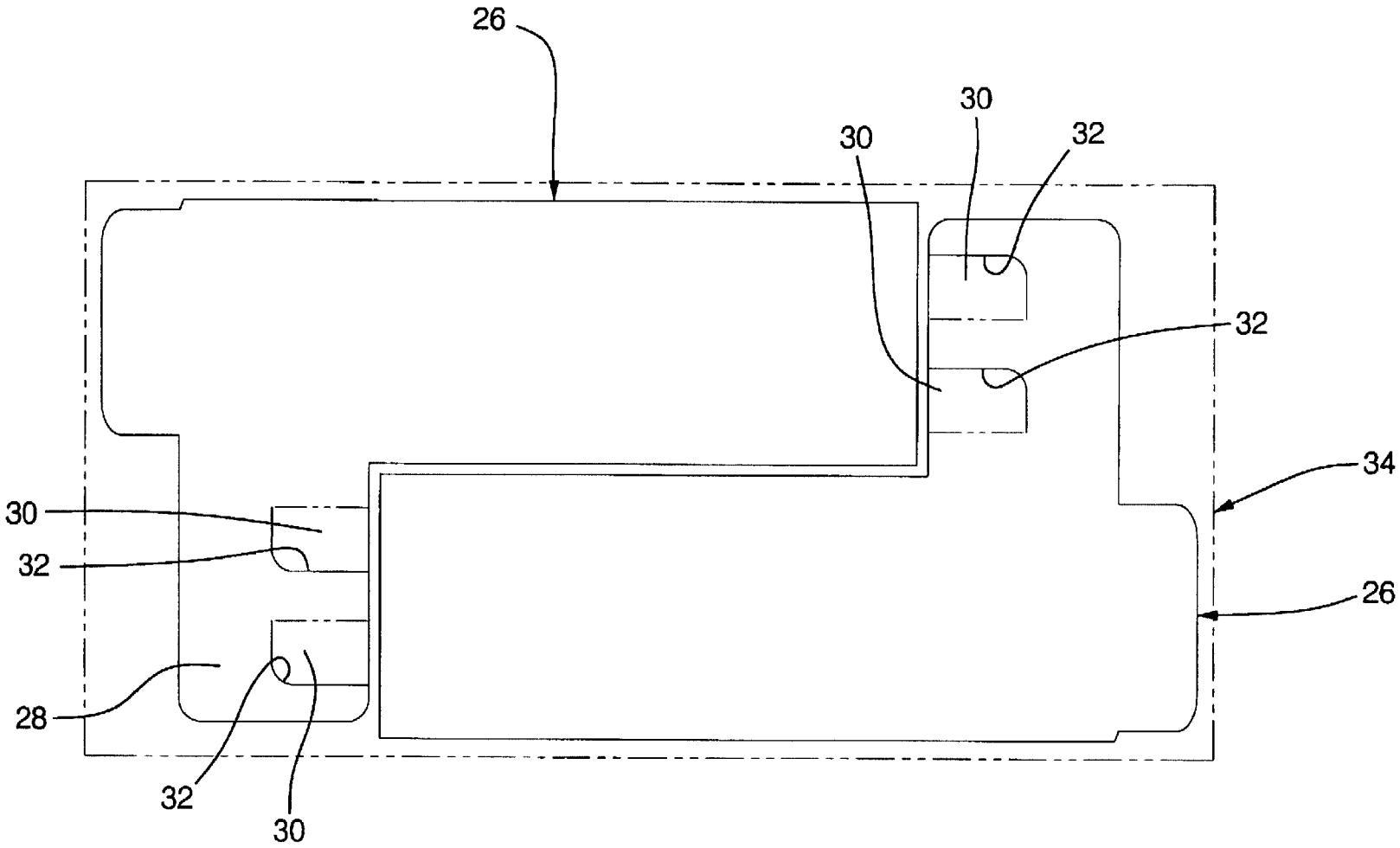
FIG. 6 is a schematic view showing a possible scheme for efficient stamping of those plates that have the integral support flanges.

Referring first to FIGS. 2 and 6, an evaporator core made according to the invention is indicated generally at 22. Core 22, as is typical, is comprised of a laminated stack of essentially identical stamped plates, three of which are indicated at 24. The plates 24 are basically the same as the plates 12 described above. Each plate 24 would be stamped from a suitable aluminum alloy in the 3000 series, approximately fifteen to twenty thousandths of an inch thick, and clad on both sides with a conventional aluminum-silicon alloy braze layer. The plates 24 are brazed in abutted pairs, and conventional corrugated like the fins 16 described above are brazed in the space between the plate pairs. Refrigerant flows through the generally U shaped flow passages formed by the fused pairs of plates 24, as indicated by the arrows. One or more of the plates differ, however, one of which is indicated generally at 26. Plate 26 is formed of the same material and has all the same features as any of the other plates 24 but has an additional, though integral, structural feature. This is a feed pipe support flange 28, which is a rectangular extension of the side edge of the plate 26, coplanar thereto, located and sized according to considerations detailed below. Folded integrally out of the flange 28 are a pair of generally rectangular support shelves 30, each of which is substantially perpendicular to the coplanar plate 26 and flange 28. Each shelf 30 is the residue of an adjacent a corresponding notch 32. Since both surfaces of the aluminum alloy stock from which all of the plates 24 and 26 are stamped is clad with a layer of braze material, so are the surfaces of the support shelves 30. As seen in FIG. 6, the support plates 26, being significantly wider, would have to be stamped separately from the main plates 24. However, they could be twinned and stamped out of a single blank indicated at 34, thereby efficiently utilizing material. The main body of the support plates 26 would be stamped identically to the main plates 24, however, with only the support flange 28 differing. The considerations that would go into the location, shape and size of the support flange 26 and flange 28 are described next.

Figure 1:
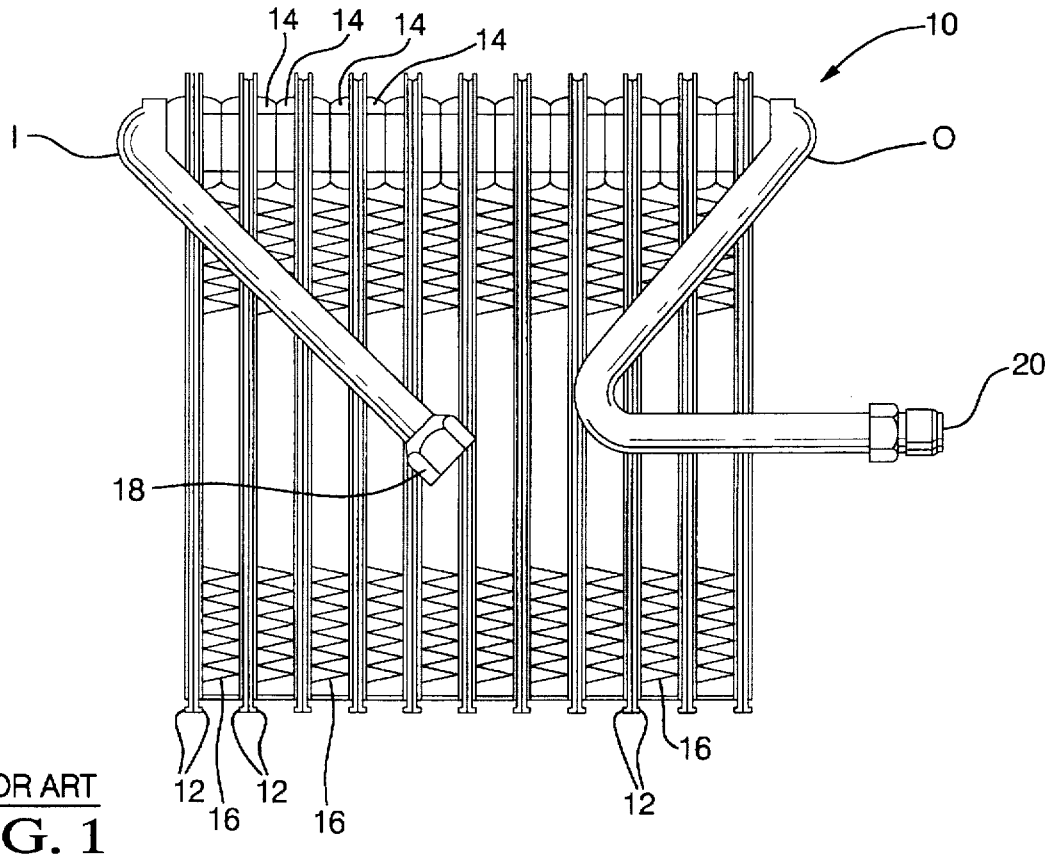
PRIOR ART FIG. 1
FIG. 1 is a face on view of a prior art evaporator described above.
Figure 3:
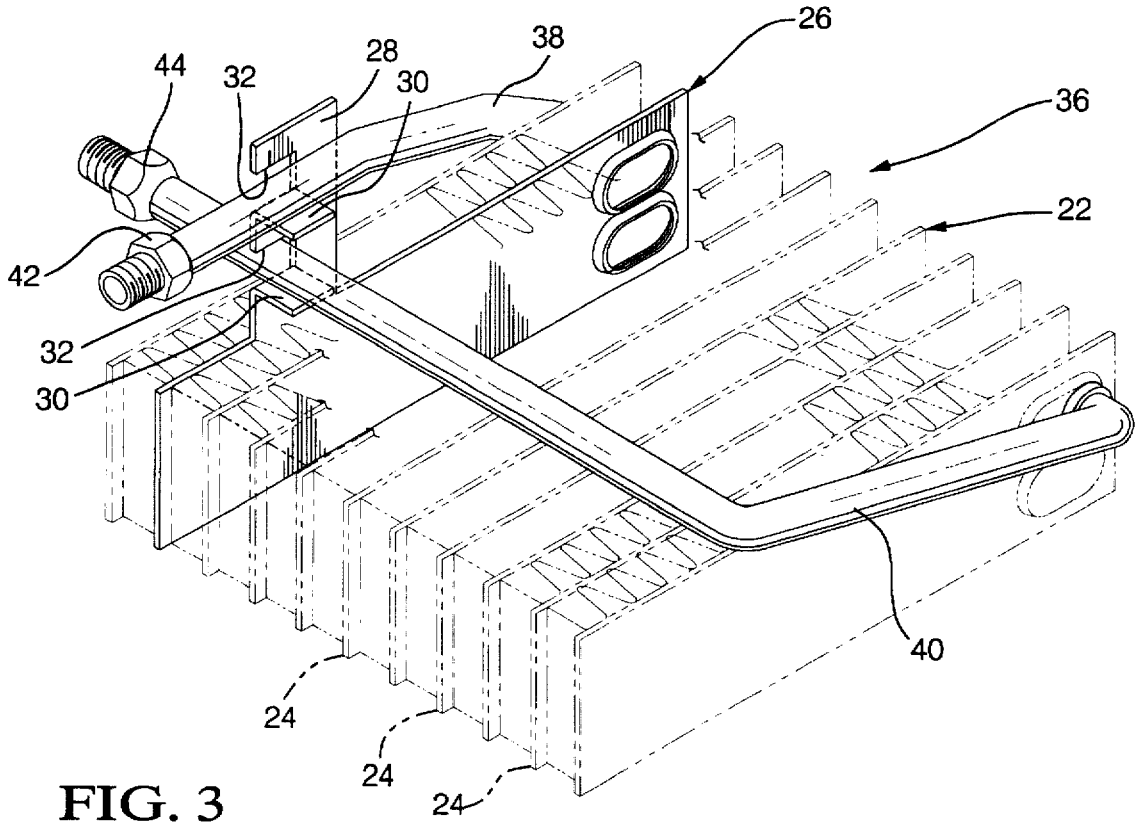
FIG. 3 is a perspective schematic view of one possible core and feed pipe configuration made according to the invention.

Referring next to FIG. 3, one possible configuration of an evaporator incorporating the basic core design 22 is indicated generally at 36. Evaporator 36 consists of the core 22 and a pair of refrigerant feed pipes 38 and 40, one of which would be an inlet, and the other an outlet. Each feed pipe has a threaded attachment end point 42 and 44 respectively, to which a non illustrated refrigerant line would be attached when the air conditioning system was installed. The feed lines 38 and 40 are shown as "end plumbed," that is, feeding refrigerant into and out of the ends of the core 22, rather than into the "face" of the core 22. What is significant, however, is not the attachment of the feed pipes to the core 22, either the means or location. What is significant is the remote locations that the end points 42 and 44 must have in order to be successfully installed to the refrigerant lines. These final assembly points may vary from car line to car line, and are very often remote from one another, as well as from the points where the feed pipes 38 and 40 themselves attach to the core 22. This requires long lengths of unsupported pipe in between. One such possible configuration of the feed pipes 38 and 40, chosen for illustration, puts the end points 42 and 44 near together, but crossing 90 degrees apart, near one corner of core 22. In any particular case, the general location and direction of the refrigerant supply lines will be predetermined by other factors in the design of the vehicle and body, and the designer of the particular evaporator must take them as a given.

What the designer of core 22 would do would be to determine, given the installation location of core 22 in the vehicle (also a given), approximately where the end points 42 and 44 should be located relative to the core 22 in order to assure installation compatibility with the predetermined refrigerant supply lines' location. Then, the location of the plate or plates 24 closest to the approximate end point locations would be determined. That particular plate (or plates) 24 would be chosen for replacement by a support plate 26. The flange 28 on support plate 26, in turn, would be sized and located so that the support shelves 30 were at the proper level to hold the pipes 38 and 40, coinciding as closely as possible to the final locations of the respective attachment end points 42 and 44. For the embodiment shown in FIG. 3, one support plate 26 only with one flange 28 only is sufficient. To assemble evaporator 36, core 22 would be stacked and bundled as usual, with the addition of support plate 26 in place of the selected plate 24 being the only difference. In some cases, automatic stacking and bundling equipment might have to be altered somewhat to accommodate the support plate 26 with its protruding flange 28. Then, the feed pipes 38 and 40 would be inserted into the core 22, either into fittings provided for that insertion, or directly. If fittings were provided for the insertion of the pipes 38 and 40 into the core 22, the would not have to be designed to allow for the later welding in of the feed pipes 38 and 40, since they are brazed simultaneously with the core 22 itself. When the feed pipes 38 and 40 are inserted into core 22, their attachment end points 42 and 44 are rested near the support shelves 30, near enough that very little unsupported length of pipe protrudes beyond. The fit of the pipes 38 and 40 within the notches 32 can be made snug enough to pinch the pipes 38 and 40 and hold them temporarily in place if desired. Finally, the stacked and bundled core 22, with pipes 38 and 40, is placed in a braze oven in the orientation shown, with the pipes 38 and 40 resting on the upwardly facing surfaces of the support shelves 30. During the braze process, the heat may cause the unsupported length of the pipes 38 and 40 to sag. This, however, is irrelevant so long as the location of the end points 42 and 44 are assured. The flanges 28 are short and stiff enough to be rigid and to so assure the proper endpoint locations, in combination with the short shelves 30. The flanges 28 are nearly as resistant to deformation in the braze oven as the plates 24 themselves, of course. Besides the support provided during the braze process, when the heated core 22 and pipes 38 and 40 are allowed to cool, the pipes 38 and 40 actually fuse to the flange support shelves 30 near the end points 42 and 44, providing additional support and good protection against damage and dislodging during shipping and handling. Furthermore, during installation of the air conditioning system, the solid support of the end points 42 and 44 would assist in threading on the refrigerant supply lines.

Figure 4:
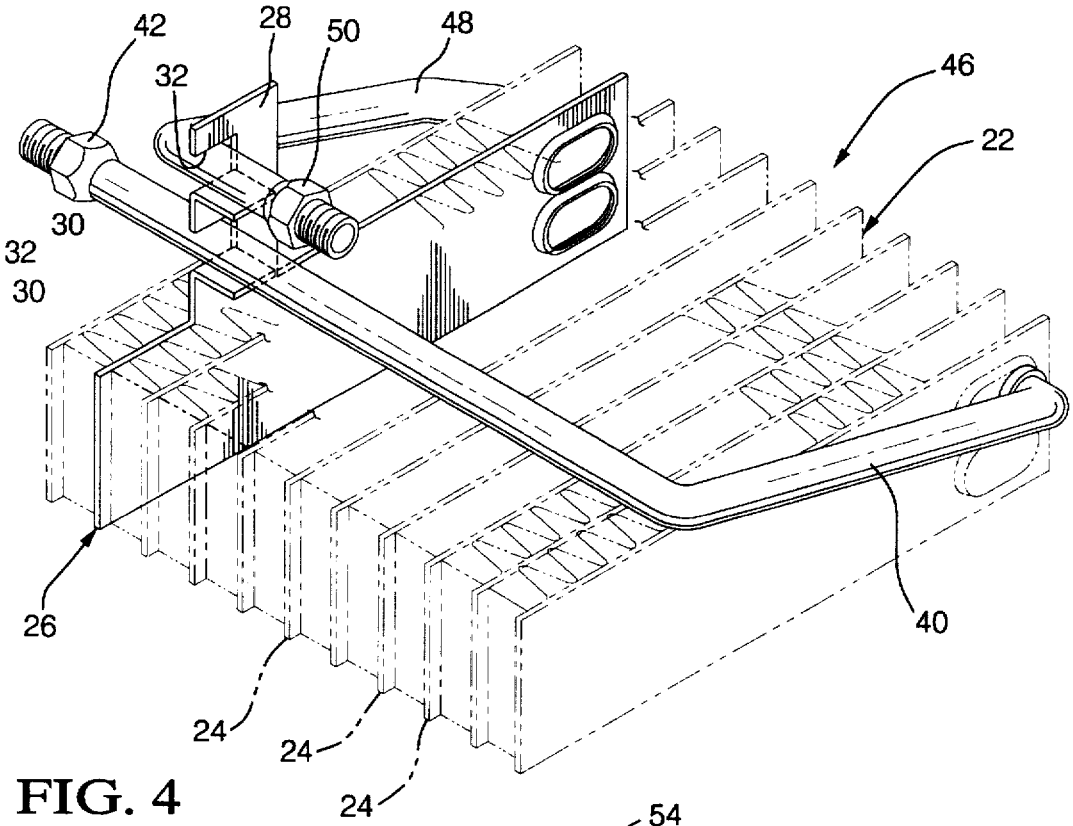
FIG. 4 is a view like FIG. 3 showing another possible configuration.

Referring next to FIG. 4, another possible evaporator configuration built off of the same core 22, and even using the same pipe support plate 26, is indicated generally at 46. Here, one of the feed pipes, 40 is the same as in the FIG. 3 configuration, and its attachment end point 42 is identically located. The other feed pipe 48 is bent around in the other direction, however, and runs though the upper notch 32 and across the upper support shelf 30 in the opposite direction. Its attachment end point 50 is similarly supported, but in a new location, by the same basic structure.

Figure 5:
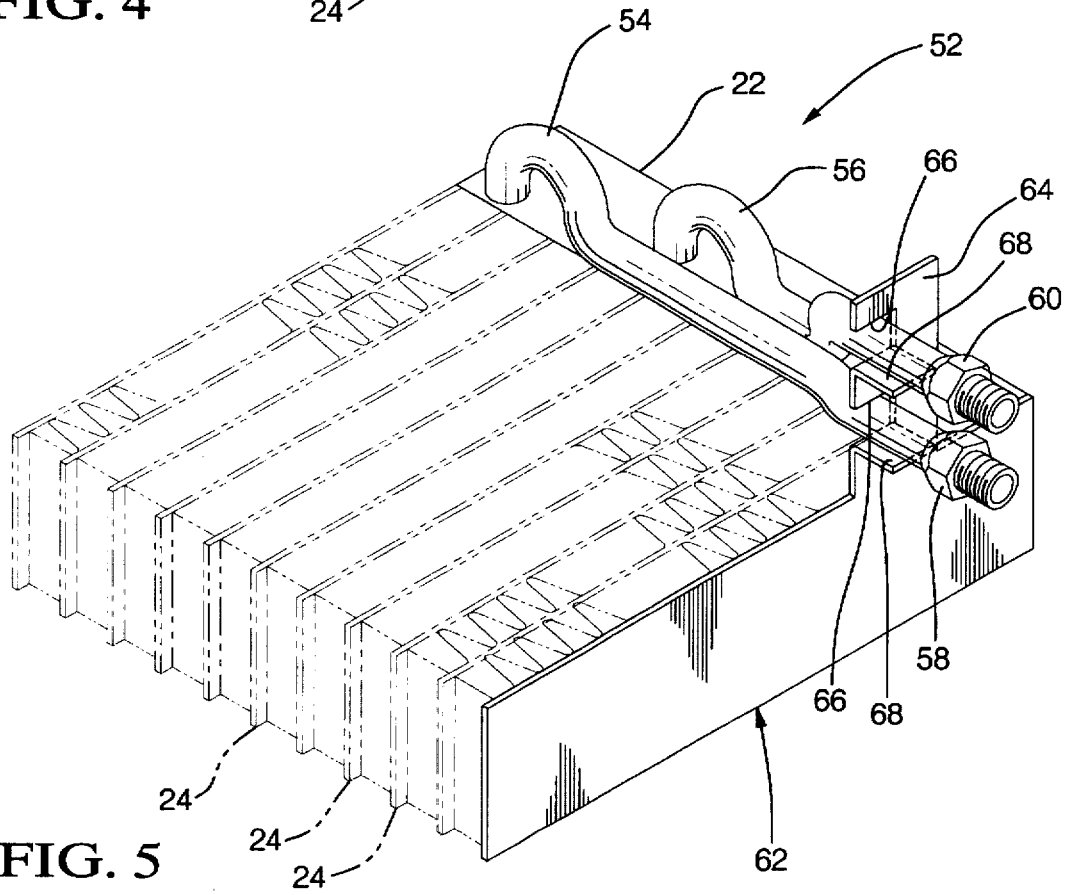
FIG. 5 shows yet another possible configuration.

FIG. 5 shows yet another evaporator 52 designed by the same process. Here, the same basic core 22 is also used, but the feed pipes 54 and 56 are both plumbed into the face of the core 22, and run toward the same end of core 22, terminating at respective attachment end points 58 and 60 located near the end of core 22. Therefore, the pipe support plate differs accordingly, both as to location within the core 22, and as to location of the support flange on the support plate. Specifically, the support plate 62 constitutes the end or side plate of core 22 and, as a consequence, might be stamped of a thicker material, without the bump pattern and divider ribs that characterize the central plates 24. The support flange 64 is similar to support flange 28, but located closer to the upper edge of the core 22. It includes the same kinds of notches 66 and support shelves 68. It will be noted that the feed pipes 54 and 56 are illustrated as being highly curved along their length, which could be, in any particular case, the result of pre bending so as to clear other components within the vehicle, or a result of sagging in the braze oven.

An almost unlimited number of configurations could be provided under the same basic design principals. If the feed pipes terminated at widely divergent locations, more than one support plate, or even one support plate with two widely spaced support flanges, could be used. A support flange with only one notch and shelf could be used to support a single feed pipe attachment end points, in a case where the end points were not proximate. A notch opening upwardly, rather than to the side, could be used, with or without a support shelf. Since the support shelves can be folded out simply as the residue of the notches, they are an essentially cost free means of providing extra support, however. Or, the support flanges could support the feed pipe ends on thin protruding tabs, rather than notches and shelves. Even a pipe support surface that was not clad with braze material, and did not actually fuse to the feed pipe, would provide solid support for the attachment end point during brazing. Since the plate stock invariably will be clad both sides with braze material, the fusion to the feed pipe and extra support provided thereby is another essentially cost free advantage. In every case, the elimination of the necessity of providing a separate, post braze step of welding the feed pipes to the evaporator core, or of providing separate clips on the core, is a very significant labor and cost savings. Therefore, it will be understood that it is not intended to limit the invention to just the embodiments disclosed.

I claim:

1. In a heat exchanger of the type having a brazed, multi-plate core and elongated feed pipes with fluid line attachment end points remote from said core, a method for integrally fixturing said feed pipes to said core, comprising the steps of, determining approximate final end point locations of said feed pipes relative to a completed core, determining one of said core plates located closest to said final end point locations, providing said one core plate with rigid support flanges integral to said one plate and substantially coincident to said final end point locations, assembling said core with said feed pipe end points supported by said flanges, and, brazing said core simultaneously with said feed pipes, thereby locating said feed pipe end points in substantially said final end point locations.

2. In a heat exchanger of the type having a brazed, multi-plate core and elongated feed pipes with fluid line attachment end points remote from said core, a method for integrally fixturing said feed pipes to said core, comprising the steps of, determining approximate final end point locations of said feed pipes relative to a completed core, determining one of said core plates located closest to said final end point locations, providing said one core plate with rigid support flanges integral to said one core plate and substantially coincident to said final end point locations, said flanges having support shelves extending substantially normal to said flanges, assembling said core with said feed pipe end points resting on said support flange shelves, and, brazing said core simultaneously with said feed pipes, thereby locating said feed pipe end points in substantially said final end point locations.

3. In a heat exchanger of the type having a brazed, multi-plate core and elongated feed pipes with fluid line attachment end points remote from said core, a method for integrally fixturing said feed pipes to said core, comprising the steps of, determining approximate final end point locations of said feed pipes relative to a completed core, determining one of said core plates located closest to said final end point locations, cladding said core plates with a layer of braze material on a least one surface thereof, providing said one core plate with rigid support flanges integral to said one core plate and substantially coincident to said final end point locations, said flanges having support shelves extending substantially normal to said flanges with an upwardly facing surface of said shelves being clad by said braze layer, assembling said core with said feed pipe end points resting on said support flange shelves upwardly facing surfaces, and, brazing said core simultaneously with said feed pipes, thereby fusing said feed pipe end points to said flange support shelves and locating said feed pipe end points in substantially said final end point locations.

* * * * *